US008347523B2

(12) United States Patent
Chung

(10) Patent No.: US 8,347,523 B2
(45) Date of Patent: Jan. 8, 2013

(54) CLOTHING DRYER

(75) Inventor: Young Suk Chung, Hwaseong-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 632 days.

(21) Appl. No.: 12/585,046

(22) Filed: Sep. 1, 2009

(65) Prior Publication Data

US 2010/0088918 A1 Apr. 15, 2010

(30) Foreign Application Priority Data

Oct. 13, 2008 (KR) ..... 10-2008-100012

(51) Int. Cl.
*F26B 11/02* (2006.01)

(52) U.S. Cl. ..... 34/130; 34/595; 34/606; D32/25; 68/5 R

(58) Field of Classification Search ..... 34/130, 34/595, 601, 606, 610; 68/5 R, 17 R, 20; D32/25
See application file for complete search history.

(56) References Cited

U.S. PATENT DOCUMENTS

| | | | | | |
|---|---|---|---|---|---|
| 1,903,564 | A * | 4/1933 | Shaffner | 68/4 |
| 3,316,659 | A * | 5/1967 | Lauck | 34/600 |
| 3,344,532 | A * | 10/1967 | Bigler | 34/600 |
| 3,724,095 | A * | 4/1973 | Laue et al. | 34/139 |
| 3,798,788 | A * | 3/1974 | Kuntz | 34/104 |
| 3,813,794 | A * | 6/1974 | Jawor | 34/136 |
| 4,109,397 | A * | 8/1978 | Daily | 34/239 |
| 4,677,760 | A * | 7/1987 | St. Louis | 34/90 |
| 4,908,959 | A * | 3/1990 | Kretchman et al. | 34/609 |
| D314,262 | S * | 1/1991 | Kretchman et al. | D32/25 |
| 5,220,734 | A * | 6/1993 | Carver | 34/600 |
| 5,743,025 | A * | 4/1998 | Jordan, Jr. | 34/600 |
| 6,212,792 | B1 * | 4/2001 | Bier | 34/315 |
| 6,374,644 | B1 * | 4/2002 | Rhode et al. | 68/20 |
| D475,821 | S * | 6/2003 | DesForges | D32/25 |
| 7,552,545 | B2 * | 6/2009 | Crawford et al. | 34/600 |
| 7,591,082 | B2 * | 9/2009 | Lee et al. | 34/600 |
| 8,015,727 | B2 * | 9/2011 | Lee et al. | 34/601 |
| 8,087,184 | B2 * | 1/2012 | Banta et al. | 34/602 |
| 2005/0261604 | A1 * | 11/2005 | Stephens et al. | 600/567 |
| 2008/0163651 | A1 * | 7/2008 | Jeong et al. | 68/5 C |
| 2010/0088918 | A1 * | 4/2010 | Chung | 34/130 |
| 2010/0132218 | A1 * | 6/2010 | Etemad et al. | 34/483 |

FOREIGN PATENT DOCUMENTS

| | | | |
|---|---|---|---|
| EP | 2175064 | A1 * | 4/2010 |
| GB | 1 491 852 | | 11/1977 |
| JP | 10328495 | A * | 12/1998 |

OTHER PUBLICATIONS

European Search report dated Feb. 15, 2010, issued in corresponding European Patent Application No. 01916791.

* cited by examiner

*Primary Examiner* — Stephen M. Gravini
(74) *Attorney, Agent, or Firm* — Staas & Halsey LLP

(57) ABSTRACT

A clothing dryer including a rotating drum, a shelf installed inside the rotating drum, and a support member, which is rotatably installed at a rear end of the shelf such that the shelf is supported by a rear surface of the rotating drum. The rear end of the shelf is installed on a rear surface of the rotating drum through the support member, so that the shelf is more stably installed inside the rotating drum.

14 Claims, 4 Drawing Sheets

CLOTHING DRYER

CROSS-REFERENCE TO RELATED APPLICATIONS

This application claims the benefit of Korean Patent Application No. 10-2008-0100012 filed on Oct. 13, 2008, in the Korean Intellectual Property Office, the disclosure of which is incorporated herein by reference.

BACKGROUND

1. Field

The present invention relates to a clothing dryer. More particularly, the present invention relates to a clothing dryer having a shelf that is detachably installed in a rotating drum.

2. Description of the Related Art

In general, a clothing dryer is an apparatus used to dry clothing by introducing hot air into a rotating drum while rotating the rotating drum accommodating wet clothes at a low speed.

A conventional clothing dryer includes a housing forming an external appearance of the clothing dryer, a rotating drum, which is rotatably installed in the housing and has a cylindrical shape having an open front surface to accommodate clothes therein, a support plate rotatably supporting an open front end of the rotating drum, a driving device for rotating the rotating drum and a drying unit which generates hot air and provides the hot air to the rotating drum.

In addition, since such a clothing dryer performs the drying operation by repeatedly lifting and dropping the clothes according to the operation of the rotating drum, when heavy clothes, such as shoes, are washed, the clothes may be damaged or noise may be generated when the heavy clothes are dropped down.

Accordingly, a shelf that can be horizontally maintained is installed in the rotating drum of the clothing dryer such that the clothes, such as shoes, are dried on the shelf.

However, in the conventional clothing dryer having the above structure, when the shelf is installed in the rotating drum, a front end of the shelf is supported by a support plate, but a rear end of the shelf is not installed in a rear surface of the rotating drum. For this reason, the shelf is installed in the rotating drum in the form of a cantilever in such a manner that only the front end of the shelf is installed in the support plate. In the case that the shelf is installed in the rotating drum in the form of cantilever, the shelf cannot support heavy load, so that heavy clothes cannot be dried on the shelf, and the shelf may be deflected when used for a long period of time.

SUMMARY

Accordingly it is an aspect of the present invention to provide a clothing dryer in which a shelf is stably installed in the rotating drum having a rear surface rotating together with a body of the rotating drum.

Additional aspects and/or advantages of the invention will be set forth in part in the description which follows and, in part, will be apparent from the description, or may be learned by practice of the invention.

The foregoing and/or other aspects are achieved by providing a clothing dryer including a rotating drum, a shelf installed inside the rotating drum, and a support member, which is rotatably installed at a rear end of the shelf such that the shelf is supported by a rear surface of the rotating drum.

According to an aspect, the clothing dryer may further include a support plate rotatably supporting an open front end of the rotating drum, and a filter member detachably installed on the support plate, where a front end of the shelf is supported by the filter member.

According to an aspect, the filter member may have a grip part protruding upward such that external force is easily applied to the filter member, and an insertion groove is formed in the shelf such that the grip part is supported in the insertion groove.

According to an aspect, the support member may include a hinge part rotatably installed on the rear end of the shelf and a plurality of leg parts, which radially extend about the hinge part and are supported by the rear surface of the rotating drum.

According to an aspect, a plurality of communication holes may be formed in the rear surface of the rotating drum such that air passes through the communication holes, and the support member may include insertion parts, which extend from each end of the leg parts and are inserted into one of the plurality of communication holes, respectively.

According to an aspect, a hinge hole may be formed in the rear end of the shelf such that the hinge part is rotatably installed in the hinge hole.

According to an aspect, a hinge installation part including material having abrasion resistance superior to that of the shelf may be formed on the rear end of the shelf, and the hinge hole may be formed in the hinge installation part.

According to an aspect, the shelf may include a shelf part for loading clothes and an installation part, which is provided on a front end of the shelf part and has the insertion groove.

According to an aspect, a through-hole may be formed in the shelf part such that air circulates while longitudinally passing through the shelf part.

It is another aspect to provide a clothing dryer including a rotating drum, a shelf installed inside the rotating drum, and a support member, which is installed at a rear surface of the rotating drum and rotates together with the rotating drum, where a center of rotation of the support member is positioned on a rear end of the shelf such that the support member supports the shelf.

As described above, the clothing dryer includes the support member, which is rotatably installed at a rear end of the shelf. Accordingly, the rear end of the shelf is installed at a rear surface of the rotating drum through the support member, so that the shelf can be stably installed in the rotating drum.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF EMBODIMENTS

Figure 1:
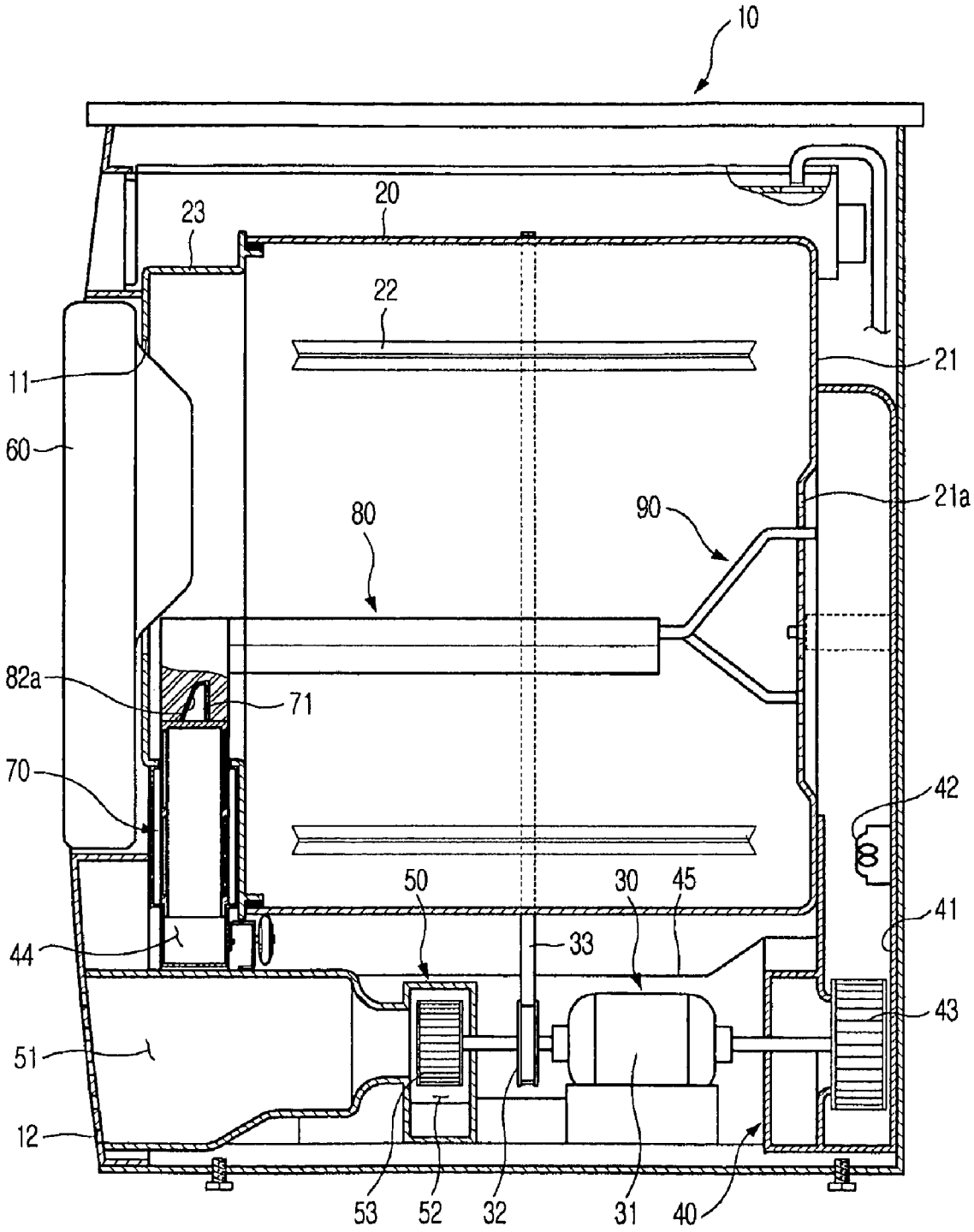
FIG. 1 is a sectional view showing a schematic structure of a clothing dryer according to an embodiment.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a clothing dryer according to an embodiment includes a housing 10 forming an external appearance of the clothing dryer, a rotating drum 20 rotatably installed in the housing 10, a driving unit 30 for generating torque to rotate the rotating drum 20, a drying unit 40 for generating hot air, a condenser (not shown) for condensing moisture contained in the hot air, a cooling unit 50 for providing cool air and a water tank (not shown) for storing water generated from the condenser.

The housing 10 is provided at a front surface thereof with an input opening 11 through which clothes are input into the rotating drum 20. A door 60 is hinged to a front side of the input opening 11 to open/close the input opening 11.

The rotating drum 20 is rotatably installed inside the housing 10. A plurality of lifters 22 are disposed inside the rotating drum 20 in the circumferential direction of the rotating drum 20. The lifters 22 allow the clothes to be lifted and dropped such that the clothes are effectively dried.

The rotating drum 20 is open forward and an open front end of the rotating drum 20 is rotatably installed against a support plate 23. A plurality of communication holes 21*a* are formed at a rear surface 21 of the rotating drum 20 such that air passes through the communication holes 21*a*. Accordingly, air heated by the drying unit 40, that is, hot air is introduced to the inside of the rotating drum 20 through the communication holes 21*a*.

The driving unit 30 includes a motor 31 for generating torque, a pulley 32 rotated by the motor 31 and a belt 33 for connecting the pulley 32 to the rotating drum 20 to transfer power of the motor 31 to the rotating drum 20.

The drying unit 40 heats up air and circulates the heated air to dry the clothes contained in the rotating drum 20. The drying unit 40 includes a heating duct 41 installed at the rear surface 21 of the rotating drum 20 to provide hot air to the rotating drum 20, a heater 42, which is disposed in the heating duct 41 to heat the air passing through the heating duct 41 to generate hot air, a circulation fan 43 allowing the air to be transferred to the rotating drum 20 through the heating duct 41, a hot air discharge duct 44 installed on the support plate 23 to allow air, which has passed through the rotating drum 20, to be discharged, and a hot air circulation passage 45 for guiding the air, which has passed through the condenser, to the heating duct 41.

A filter member 70 is detachably installed on the hot air discharge duct 44 to filter alien substances such as lint. A grip part 71 protrudes from an upper end of the filter member 70 such that the filter member 71 is easily separated from the hot air discharge duct 44.

The cooling unit 50 includes an intake passage 51 for drawing outdoor air through a suction port 12 provided at one side of the housing 10, an exhaust passage 52 allowing air, which has passed through the condenser, to be discharged out of the housing 10, and a cooling fan 53 allowing the air to pass through the intake passage 51, the condenser and the exhaust passage 52.

Although not shown in the drawings, the condenser is disposed between the hot air discharge duct 44 and the hot air circulation passage 45, and between the intake passage 51 and the exhaust passage 52 such that hot air, which circulates from the hot air discharge duct 44 to the hot air circulation passage 45, is cooled by the air circulating from the intake passage 51 to the exhaust passage 52, thereby condensing moisture contained in the hot air.

Figure 2:
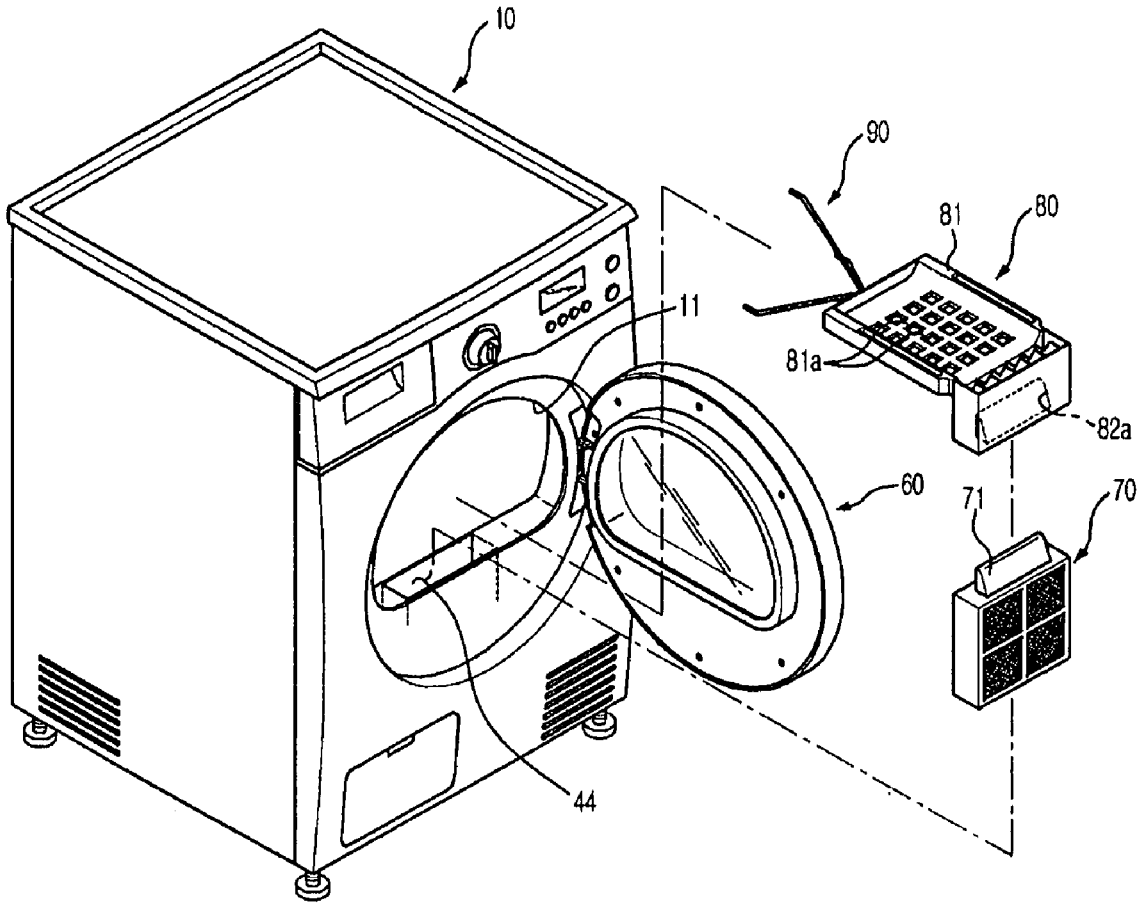
FIG. 2 is a perspective view showing a filter member and a shelf applied to the clothing dryer, which are separated from each other, according to the embodiment.
Figure 3:
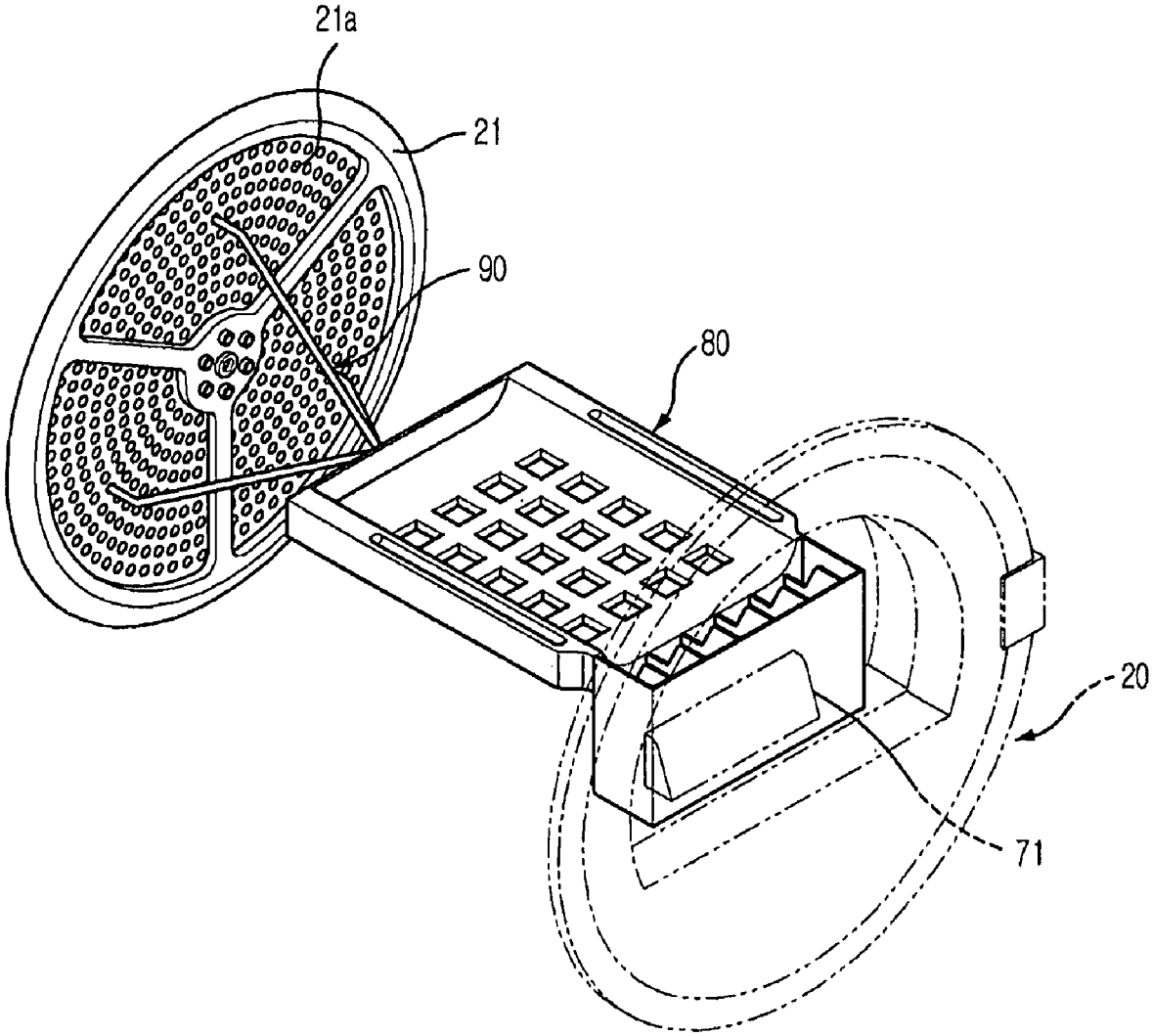
FIG. 3 is a perspective view showing the filter member and the shelf applied to the clothing dryer, which are assembled with each other, according to the embodiment.

In addition, according to the clothing dryer of the present embodiment, as shown in FIGS. 2 and 3, a shelf 80 is detachably installed in the rotating drum 20 to dry the clothes such as shoes. A front end of the shelf 80 is supported by the support plate 23, and a rear end of the shelf 80 is supported by the rear surface 21 of the rotating drum 20 through a support member 90. The support member 90 is installed on the rear surface 21 of the rotating drum 20 and has a center of rotation positioned on the rear end of the shelf 80 such that the rear end of the shelf 80 is supported by the rear surface 21 of the rotating drum 20. Accordingly, since the front end and the rear end of the shelf 80 are supported, even if heavy clothes are loaded on the shelf 80, the shelf 80 stably supports the clothes.

Since the hot air discharge duct 44 is provided below the support plate 23 and the filter member 70 is installed on the hot air discharge duct 44, the front end of the shelf 80 is supported by the support plate 23 through the filter member 70. An insertion groove 82*a*, into which a grip part 71 is inserted, is recessed at a front lower part of the shelf 80 such that the front end of the shelf 80 is stably installed on the filter member 70. The shelf 80 includes a shelf part 81 and a support part 82. The clothes are loaded on the shelf part 61 having a through-hole 81*a* allowing air to pass therethrough. The support part 82 is provided at a front end of the shelf part 81 and has the insertion groove 82*a* formed at a lower surface thereof such that the support part is supported by the filter member 70.

Figure 4:
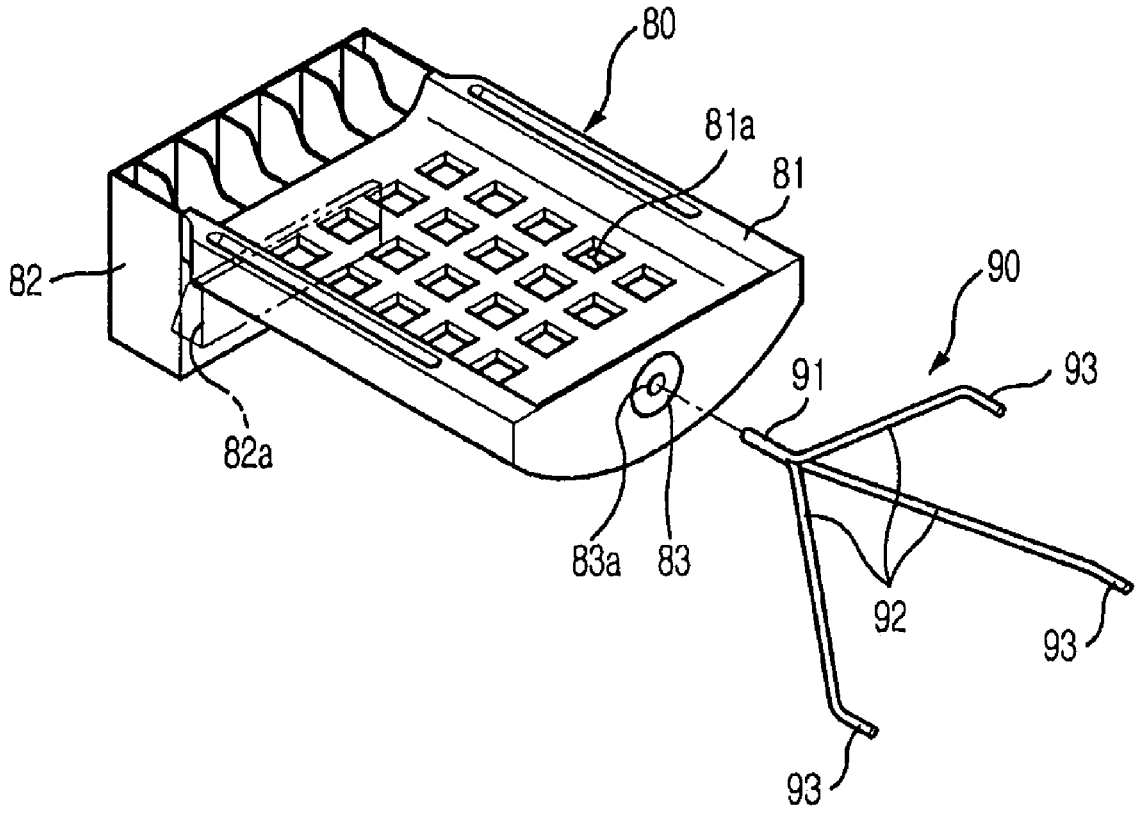
FIG. 4 is a perspective view showing the shelf and the support member applied to the clothing dryer according to the embodiment.

As shown in FIG. 4, the support member 90 includes a hinge part 91, which is rotatably installed on the rear end of the shelf 80 while forming the center of rotation of the support member 90 and a plurality of legs 92 radially extending about the hinge part 91 to be supported by the rear surface 21 of the rotating drum 20. An insertion part 93 is provided at each end of the legs part 92 and is inserted into one of the communication holes 21*a*. The support member 90 includes three leg parts 92 and is provided in the form of a tripod.

In addition, a hinge hole 83*a* is formed in the rear end of the shelf 80 such that the hinge part 91 is rotatably installed in the hinge hole 83*a*. A hinge installation part 83 is installed at the rear end of the shelf 80 and includes material having abrasion resistance superior to that of material forming the shelf 80 such that the hinge hole 83*a* is provided on the hinge installation part 83. Accordingly, the friction is prevented from being generated between the hinge part 91 and the hinge hole 83*a* when the support member 90 rotates. In addition, the hinge hole 83*a* is prevented from becoming larger due to the abrasion of the hinge part 91 and the hinge hole 83*a* caused by the friction.

Accordingly, if the hinge part 91 of the support member 90 is installed in the hinge hole 83*a* of the shelf 80 such that the insertion part 93 is inserted into the communication hole 21*a* of the rear surface 21 of the rotating drum 20, the support member 90 rotates together with the rotating drum 20. Even if the support member 90 rotates, the hinge part 91 formed on the center of rotation of the support member 90 keeps a constant position, so that the rear end of the shelf 80 is supported by the support member 90. Accordingly, the front end of the shelf 80 is supported by the support plate 23 through the filter member 70, and the rear end of the shelf 80 is supported by the rear surface 21 of the rotating drum 20 through the support member 90, so that the shelf 80 is stably supported in the rotating drum 20.

Although the present embodiment has been described in that the hinge installation part 83 having the hinge hole 83*a* is installed on the rear end of the shelf 80 as a separate member, the present invention is not limited thereto. According to another embodiment, the hinge hole 83*a* may be directly formed in the rear end of the shelf 80.

Although few embodiments of the present invention have been shown and described, it would be appreciated by those skilled in the art that changes may be made in these embodiments without departing from the principles and sprit of the invention, the scope of which is defined in the claims and their equivalents.

What is claimed is:

1. A clothing dryer comprising:

a rotating drum;

a shelf installed inside the rotating drum; and a support member, which is rotatably installed at a rear end of the shelf such that the shelf is supported by a rear surface of the rotating drum, wherein the support member is configured to rotate together with the rotating drum according to a rotation of the rotating drum.

2. The clothing dryer as claimed in claim 1, further comprising:

a support plate rotatably supporting an open front end of the rotating drum; and a filter member detachably installed on the support plate, wherein a front end of the shelf is supported by the filter member.

3. The clothing dryer as claimed in claim 2, wherein the filter member has a grip part protruding upward such that external force is easily applied to the filter member, and an insertion groove is formed in the shelf such that the grip part is supported in the insertion groove.

4. The clothing dryer as claimed in claim 1, wherein the support member includes a hinge part rotatably installed on the rear end of the shelf and a plurality of leg parts, which radially extend about the hinge part and are supported by the rear surface of the rotating drum.

5. The clothing dryer as claimed in claim 4, wherein a plurality of communication holes are formed in the rear surface of the rotating drum such that air passes through the communication holes, and the support member includes insertion parts, which extend from each end of the leg parts and are inserted into one of the plurality of communication holes, respectively.

6. The clothing dryer as claimed in claim 4, wherein a hinge hole is formed in the rear end of the shelf such that the hinge part is rotatably installed in the hinge hole.

7. The clothing dryer as claimed in claim 6, wherein a hinge installation part including material having abrasion resistance superior to that of the shelf is formed on the rear end of the shelf, and the hinge hole is formed in the hinge installation part.

8. The clothing dryer as claimed in claim 3, wherein the shelf includes a shelf part for loading clothes and an installation part, which is provided on a front end of the shelf part and has the insertion groove.

9. The clothing dryer as claimed in claim 8, wherein a through-hole is formed in the shelf part such that air circulates while longitudinally passing through the shelf part.

10. A clothing dryer comprising:

a rotating drum;

a shelf installed inside the rotating drum; and a support member, which is installed at a rear surface of the rotating drum and rotates together with the rotating drum according to a rotation of the rotating drum, wherein a center of rotation of the support member is positioned on a rear end of the shelf such that the support member supports the shelf.

11. The clothing dryer as claimed in claim 10, wherein the shelf is provided at the rear end thereof with a hinge hole, on which the center of rotation of the support member, which rotates together with the rotating drum, is positioned.

12. The clothing dryer as claimed in claim 11, wherein a hinge installation part including material having abrasion resistance superior to that of the shelf is formed on the rear end of the shelf, and the hinge hole is formed in the hinge installation part.

13. The clothing dryer as claimed in claim 11, wherein the support member includes a hinge part, which is installed in the hinge hole while forming the center of rotation of the support member, and a plurality of leg parts which radially extend about the hinge part and are supported by the rear surface of the rotating drum.

14. The clothing dryer as claimed in claim 13, wherein a plurality of communication holes are formed in the rear surface of the rotating drum such that air passes through the communication holes, and the support member includes insertion parts, which extend from each end of the leg parts and are inserted into one of the plurality of communication holes, respectively.

* * * * *